US007300706B2

(12) United States Patent
Adriaensen et al.

(10) Patent No.: US 7,300,706 B2
(45) Date of Patent: Nov. 27, 2007

(54) HIGH-CARBON STEEL WIRE WITH NICKEL SUB COATING

(75) Inventors: Ludo Adriaensen, Deerlijk (BE); Paul Dambre, Kemmel (BE); Danny Gonnissen, Roeselare (BE); Gilbert Van Loo, Harelbeke (BE); Johan Vanbrabant, Zwevegem (BE)

(73) Assignee: NV Bekaert SA, Zwevegem (BE)

( * ) Notice: Subject to any disclaimer, the term of this patent is extended or adjusted under 35 U.S.C. 154(b) by 27 days.

(21) Appl. No.: 11/494,772

(22) Filed: Jul. 28, 2006

(65) Prior Publication Data

US 2007/0026253 A1 Feb. 1, 2007

Related U.S. Application Data

(63) Continuation of application No. PCT/EP05/50074, filed on Jan. 10, 2005.

(30) Foreign Application Priority Data

Feb. 4, 2004 (EP) ..... 04100391
Feb. 4, 2004 (EP) ..... 04100392

(51) Int. Cl.
*B32B 15/02* (2006.01)
*B32B 15/18* (2006.01)

(52) U.S. Cl. ..... 428/607; 428/632; 428/658; 428/659; 428/667; 428/679; 72/47; 427/357; 427/406

(58) Field of Classification Search ..... None
See application file for complete search history.

(56) References Cited

U.S. PATENT DOCUMENTS

| | | | | |
|---|---|---|---|---|
| 2,918,722 | A * | 12/1959 | Kenmore | 428/658 |
| 3,749,558 | A * | 7/1973 | Dilenschneider | 428/675 |
| 4,850,395 | A | 7/1989 | Briggs | |
| 4,929,512 | A * | 5/1990 | Nishimura et al. | 428/610 |
| 5,380,407 | A * | 1/1995 | Yamaoka et al. | 205/122 |
| 5,389,163 | A * | 2/1995 | Hachisuka | 148/532 |
| 6,935,008 | B2 * | 8/2005 | Miyazaki et al. | 29/424 |
| 2003/0079811 | A1 | 5/2003 | Hesske | |

FOREIGN PATENT DOCUMENTS

| | | |
|---|---|---|
| EP | 480 122 A2 | 4/1992 |
| GB | 1 175 623 A | 12/1986 |

(Continued)

OTHER PUBLICATIONS

Machine generated translation of JP 11-200070.*

(Continued)

*Primary Examiner*—John J. Zimmerman
(74) *Attorney, Agent, or Firm*—Shlesinger, Arkwright & Garvey LLP

(57) ABSTRACT

A wire for external exposure, i.e. without chemical binding with a polymer or rubber matrix. The wire has a steel core, a nickel sub-coating and a zinc or zinc alloy top coating above the nickel sub-coating. The steel core has a carbon content exceeding 0.20%. The wire is in a work-hardened state by drawing or rolling. The wire has an excellent corrosion resistance and provides an excellent barrier against hydrogen. Preferable uses are wires in off-shore applications.

19 Claims, 1 Drawing Sheet

FOREIGN PATENT DOCUMENTS

| | | | |
|---|---|---|---|
| JP | 1-222090 | * | 9/1989 |
| JP | 9-25595 | * | 1/1997 |
| JP | 09-263926 | * | 10/1997 |
| JP | 11-200070 | | 7/1999 |
| JP | 2002-069687 | * | 3/2002 |
| WO | WO 91/12359 | * | 8/1991 |
| WO | 97/42352 | | 11/1997 |
| WO | 99/64168 | | 12/1999 |
| WO | 02/088459 | | 11/2002 |

OTHER PUBLICATIONS

International Search Report dated Jul. 26, 2005 in PCT application No. PCT/EP2005/050074, filed Jan. 10, 2005 (4 pages).

* cited by examiner

HIGH-CARBON STEEL WIRE WITH NICKEL SUB COATING

CROSS-REFERENCE TO RELATED APPLICATIONS

This application is a continuation of application no. PCT/EP2005/050074, filed Jan. 10, 2005, which claims the priority of European application no. 04100391.4, Feb. 4, 2004, and which application no. PCT/EP2005/050074 claims the priority of European application no. 04100392.2, filed Feb. 4, 2004, and each of which is incorporated herein by reference.

FIELD OF THE INVENTION

The present invention relates to a wire for external exposure. The wire has a steel core and a double metal coating. The present invention also relates to various uses of such a wire and to a method of manufacturing such a wire.

BACKGROUND OF THE INVENTION

The prior art has provided a steel wire with various metallic coatings in order to add functionalities to the steel wire or in order to enhance its properties. Known metallic coatings on a steel wire are brass for adhesion with rubber, zinc or a zinc-aluminum alloy for corrosion resistance, nickel for a heat resistance.

Zinc coatings are often applied to the steel wire by means of a hot dip process for reasons of economy. Having regard to the time the steel wire is in the zinc bath and to the temperature of the zinc bath, a Fe—Zn interlayer is formed between the steel core and the zinc coating. This interlayer is brittle. Fe—Zn interlayer particles may be spread throughout the zinc coating during further drawing. Due to cracking of the Fe—Zn, sharp crevices are created which are subsequently filled with zinc. This surface damage makes the roughness of the steel wire greater and corrosion of the Fe—Zn interlayer particles at the wire surface leads very fast to red dust spots. Zinc aluminum coatings may have the drawback that the Fe—Al inter-metallic coating grows too fast and is too brittle. The consequence may be the presence of broken particles in the zinc aluminum coating and a fragmentation of the Fe—Al inter-metallic coating.

A nickel coating as such may offer various advantages such as heat resistance, but has the drawback that it deforms not easily and that it may be damaged easily. Hence its processing is difficult and not economical.

OBJECTS AND SUMMARY OF THE INVENTION

It is an object of the present invention to avoid the drawbacks of the prior art.

It is also an object of the present invention to increase the corrosion resistance of steel wires.

It is yet another and particular object of the present invention to provide steel wires with a barrier against hydrogen.

According to a first aspect of the present invention, there is provided a wire for external exposure. The terms "wire for external exposure" typically refer to wires adapted for use either outside any matrix of softer material or inside a matrix of softer material but without any chemical bond between the wire and the matrix material. The wire has a steel core, a nickel sub-coating and a zinc or zinc alloy top coating above the nickel sub-coating. It will be noted that the terms "weight percent" and "percentage by weight" will be referred to as "percent" for brevity throughout. The steel is a high-carbon steel comprising more than 0.20 percent carbon, e.g. more than 0.35 percent, e.g. more than 0.50 percent. The steel is preferably a pearlitic steel. Martensitic or bainitic steels, however, are not excluded.

The nickel sub-coating may have varying thicknesses. However, the greater the thickness of the nickel sub-coating, the better the barrier function of the nickel sub-coating. The thickness of the nickel sub-coating may vary between 0.3 μm and more than 10 μm.

A 0.3 μm nickel sub-coating corresponds to about 2.665 $g/m^2$, a 1 μm nickel sub-coating corresponds to about 8.85 $g/m^2$, a 2 μm nickel layer corresponds to about 17.70 $g/m^2$, a 5 μm nickel sub-coating to about 44.25 $g/m^2$ and a 10 μm nickel sub-coating corresponds to about 88 $g/m^2$.

The function of the nickel sub coating as a "barrier" for hydrogen may be explained as follows. Nickel is supposed to absorb the hydrogen. The absorbed hydrogen in the nickel forms a particular layer which obstructs electrical currents.

In the past attempts were done with amorphous steel cord for rubber reinforcement. The amorphous steel filaments had a nickel sub-coating of less than 1.0 μm and a top coating of zinc. The amorphous steel filaments were twisted into a steel cord and this steel cord was embedded in rubber with chemical adhesion between the steel cord and the rubber. The typical steel cord tests carried out, showed hardly any advantages or differences for these amorphous steel filaments with a nickel sub-coating and a zinc top-coating in comparison with similar steel cord filaments coated with zinc alone.

The invention wire can have a round cross-section or a non-round cross-section such as flattened, rectangular, square, zeta, and so forth.

The steel core coated with both nickel and zinc is further drawn or rolled to its final cross-section in a final work-hardened state. In other terms the steel wire is in a final drawn or rolled work-hardened state. The coatings steps are not the last steps performed on the steel core. By applying a top coating of zinc or a zinc alloy on top of the nickel sub coating, the nickel sub coating is not subjected directly to the work hardening of drawing or rolling. Zinc is now known as being better deformable than nickel, so that the deformation process occurs with the same comfort as the deformation of steel wires with only zinc or zinc alloy coating layers. In this way the invention both profits from the presence of nickel in the sub coating and from the easy deformability of zinc in the top coating.

Depending upon the typical way of manufacturing and of providing the coatings, a wire according to the invention may have following subsequent layers:

i) a steel core;

ii) a Fe—Ni alloy interlayer; this is the case if the nickel coated steel wire is subjected to a heat treatment, e.g. by going through a zinc bath; experience and tests have shown that this Fe—Ni alloy interlayer is only present if the time period for the heat treatment is sufficiently long;

iii) a nickel (Ni) sub-coating;

iv) a Ni—Zn alloy interlayer; this is the case if the zinc top coating is applied via a hot dip process; this Ni—Zn alloy interlayer may provide a good resistance against corrosion in aggressive environments (such as simulated in salt spray tests);

v) a zinc or zinc alloy top coating.

If of a sufficient thickness the nickel sub-coating may form a closed layer and prevent a brittle Fe—Zn alloy layer from being formed or prevent brittle Fe—Zn inter-metallics from being present. As a consequence, the invention wire does not have the drawbacks associated with the brittle Fe—Zn alloy layer.

The top-coating of zinc or zinc alloy may be thicker or thinner than the nickel sub-coating.

The top coating may be pure zinc or may be a zinc alloy such as a zinc aluminum alloy comprising between 0.5% and 10% aluminum, e.g. between 1.0% and 8% aluminum, e.g. about 5% aluminum. A Mischmetal such as La or Ce may be present in amounts of about 0.02%.

In a particular embodiment of the first aspect of the present invention, the invention wire comprises chromium which is present in or in contact with the nickel sub-coating. The chromium is present in the form of metallic Cr or in the form of the ion $Cr^{3+}$.

According to a second aspect of the present invention, the invention wire is suitable for various uses or applications where the invention wire has no chemical bond with a surrounding matrix. It particularly concerns applications where hydrogen embrittlement may be a problem. These applications are preferably off-shore applications.

As a first application, a non-bonded flexible pipe may comprise one or more invention wires. The term "non-bonded" refers to wires which are only mechanically anchored and where chemical adhesion is mainly absent. An electrolytic coating of nickel, if of sufficient thickness, provides an excellent barrier against hydrogen and thus avoids, or at least slows down, hydrogen embrittlement. The invention wires for reinforcement in non-bonded flexible pipes may have a round or a non-round cross-section. The non-round cross-section may be a flattened wire, a rectangular wire, a zeta wire etc. . . .

As a second application, a tow leader cable comprises one or more invention wires.

As a third application, a control cable comprises one or more invention wires.

According to a third aspect of the present invention, there is provided a method of manufacturing a wire. The method comprises the steps of:

a) providing a steel core with a carbon content above 0.20 percent;

b) coating the steel core with a nickel sub-coating;

c) coating a zinc or zinc alloy top coating on top of the nickel sub-coating;

d) drawing or rolling the wire with the nickel sub-coating and the zinc or zinc alloy top coating to a final cross-section.

The nickel sub-coating is preferably applied on the steel core by means of an electrolytic method. Electroless deposition methods or vacuum plating of nickel are not excluded.

The zinc or zinc alloy top coating is preferably applied by means of a hot dip bath. Other ways of applying the zinc or zinc alloy top coating are not excluded: e.g. in an electrolytic way. The hot dip method has as consequence that a zinc-nickel interlayer is formed and possibly also an iron-nickel interlayer. This is due to the heating of the wire during the passing through the zinc bath.

As already mentioned, due to the fact that the zinc or zinc alloy forms the top coating, the relatively undeformable nickel sub layer is not subject to the drawing or rolling treatment.

In a particular embodiment of the invention, the method of manufacturing an invention wire comprises a further step of:

e) guiding the wire in a bath of $Cr^{3+}$-salts.

BRIEF DESCRIPTION OF THE DRAWINGS

The invention will now be described into more detail with reference to the accompanying drawings wherein.

DETAILED DESCRIPTION OF THE INVENTION

Figure 1:
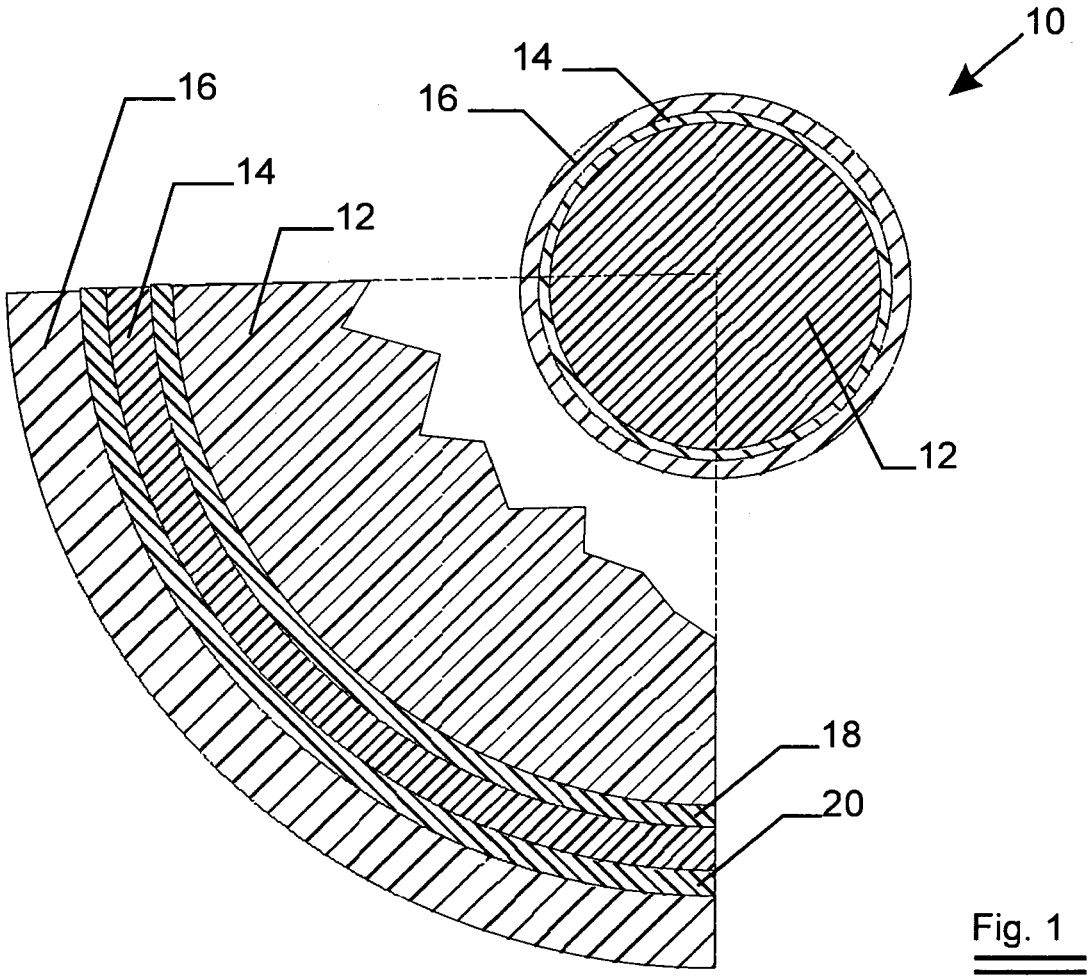
FIG. 1 shows a cross-section of an invention wire

FIG. 1 shows a cross-section of an invention steel wire 10. The invention has a pearlitic high-carbon steel core 12 with a carbon content above 0.60%. The steel core 12 has been coated with a nickel sub-coating 14 in an electrolytic way and, on above the nickel sub-coating, with a zinc top-coating 16 by means of a hot dip process.

Going into more detail with the help of the part of FIG. 1 which has been enlarged, the invention wire comprises following different metallic structures:

a steel core 12;

possibly an Fe—Ni alloy interlayer 18;

a nickel sub-coating 14 of at least 2 μm;

a Ni—Zn alloy interlayer 20;

a zinc top-layer 16.

Due to the presence of a fully closed nickel sub-coating 14, a brittle Fe—Zn alloy interlayer and sharp Fe—Zn inter-metallic particles are not formed. This is advantageous with respect to the fatigue behavior of the invention wire 10.

The Fe—Ni alloy interlayer 18 and the Ni—Zn alloy interlayer 20 are possibly formed during the hot dip process, during which the invention wire is heating above 400° C. during about 30 seconds. The longer the hot dip process takes, the more chance a Fe—Ni alloy interlayer 18 will be formed.

Figure 2:
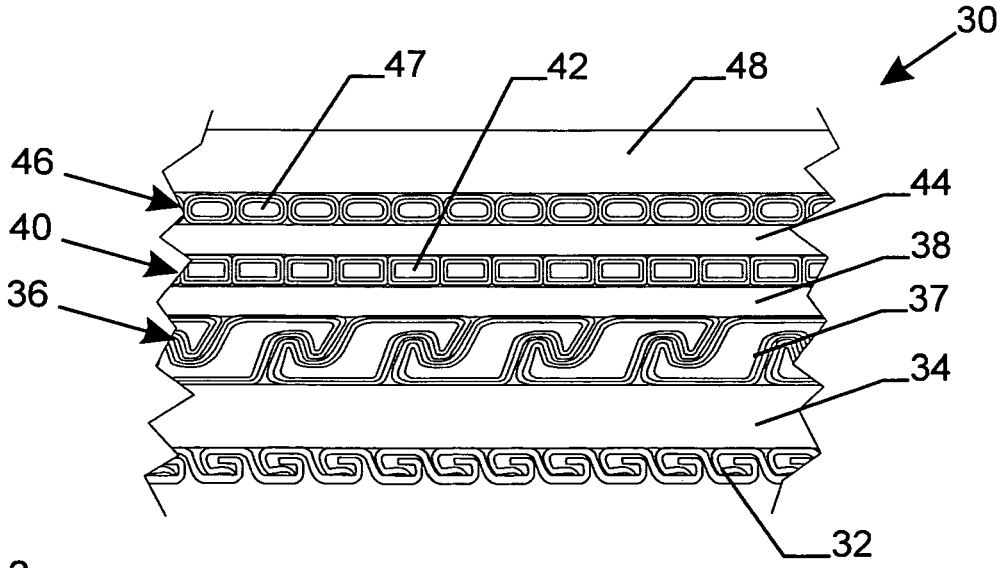
FIG. 2 shows part of a cross-section of a non-bonded flexible pipe.

FIG. 2 shows part of a cross-section of a non-bonded flexible pipe 30. The flexible pipe 30 has following subsequent layers starting from the radially inner layer:

a collapse resistant layer 32;

an inner fluid barrier 34 in polymer;

a hoop strength layer 36 with zeta martensitic steel wires 37 having a nickel sub-coating and a zinc top-coating;

an inner anti-wear layer 38;

an inner tensile strength layer 40 with flat martensitic steel wires 42 with a nickel sub-coating and a zinc top-coating;

an outer anti-wear layer 44;

an outer tensile strength layer 46 with with flat martensitic steel wires 47 with a nickel sub-coating and a zinc top-coating;

an external fluid barrier 48.

The nickel sub-coating functions as a barrier layer against the hydrogen sulfide ions ($HS^-$) which may penetrate into the several layers. Without the nickel sub-coating sulfide stress corrosion is quickly started.

EXAMPLE 1

A nickel sub-coating of 3 μm to 4 μm is plated in an electrolytic way on a carbon steel wire. A zinc top coating of about 15 μm to 25 μm is plated above the nickel sub-coating by means of a hot dip process. The thus double-coated steel wire is then drawn to a final diameter of 0.175 mm. In the final product the nickel sub-coating has a thickness of 1.0 μm and the thickness of the pure zinc top-coating is about 2 μm to 5 μm. This invention wire is compared with a prior art steel rope where the individual steel wires are only coated with zinc. A salt spray test carried out according to DIN SS 50021 and ASTM. B 117 and ISO 9227 in 10% relative humidity, at 35° C. and with 5% NaCl has provided following results.

TABLE 1

| | 0-24 hours | 24-48 hours | 48-72 hours | 72-96 hours |
|---|---|---|---|---|
| 1 | | | Spots DBR | DBR (5%) |
| 2 | | | Spots DBR | DBR (5%) |
| 3 | DBR (5%) | | | |
| 4 | DBR (5%) | | | |

Sample 1 is an invention wire not treated with oil.
Sample 2 is an invention wire treated with oil.
Sample 3 is a prior art wire not treated with oil.
Sample 4 is a prior art wire treated with oil.
DBR is the abbreviation for dark brown rust.

EXAMPLE 2

Three different wires have been compared with each other:

1. a prior art wire of 0.10 mm diameter with a zinc top-coating of 2.85 μm (200 g/m$^2$);
2. an invention wire of 0.10 mm diameter with a nickel sub-coating of 0.8 μm (6.86 g/m$^2$) and a top-coating of zinc of 2.85 μm;
3. an invention wire of 0.10 mm diameter with a nickel sub-coating of 0.8 μm (6.86 g/m$^2$) and a top-coating of zinc of 2.85 μm passivated in a bath of chromium ($Cr^{3+}$) salts.

The corrosion resistance of the three wires has been determined by monitoring the corrosion potential of such a wire in an electrolyte of demi-water. Once the protecting zinc top-coating is corroded away, the monitored potential increases from the potential of zinc to the one of iron or the mixed potential of nickel-iron. The time needed to reach the half wave potential is measured. Table 2 summarizes the results.

TABLE 2

| | Test 1 (Hours) | Test 2 (Hours) | Test 3 (Hours) | Average (Hours) |
|---|---|---|---|---|
| 1 | 17.1 | 18.4 | 19.5 | 18.3 |
| 2 | 21.6 | 22.8 | 23.9 | 22.8 |
| 3 | 50.5 | 63.4 | 65.9 | 59.9 |

The invention wire 2 with the nickel sub-coating has a better corrosion resistance than a prior art wire 1.

The corrosion resistance of invention wire 3 is unexpectedly high. At present the mechanism is not yet clear. A possible explanation may be that the $Cr^{3+}$ will transform into metallic Cr-atoms and that these Cr-atoms form a small stainless steel layer with the available Fe and Ni.

EXAMPLE 3

The corrosion resistance of following wire samples has been determined by means of a salt spray test:

1. prior art high carbon steel wire with 20 μm zinc
2. prior art high carbon steel wire with 20 μm zinc aluminum alloy (5% aluminum)
3. invention high-carbon steel wire with 2 μm nickel and 18 μm zinc aluminum (5% Al)
4. invention high-carbon steel wire with 2 μm nickel and 18 μm zinc
5. invention high-carbon steel wire with 5 μm nickel and 15 μm zinc
6. invention high-carbon steel wire with 10 μm nickel and 10 μm zinc
7. invention high-carbon steel wire with 15 μm nickel and 5 μm zinc

TABLE 3

| Wire sample | DRB 5% | | |
|---|---|---|---|
| #1 | 12 | 8 | 12 |
| #2 | 12 | 8 | 12 |
| #3 | 24 | 20 | 12 |
| #4 | 24 | 32 | 24 |
| #5 | 28 | 28 | 24 |
| #6 | 44 | 32 | 44 |
| #7 | 28 | 40 | 44 |

Investigation of the wire samples has revealed that the nickel coating is undamaged after wire drawing. The table shows that the more nickel is present, the better the corrosion results.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

The invention claimed is:

1. A wire for external exposure, said wire comprising:
a) a steel core;
b) a nickel sub-coating and one of a zinc and a zinc alloy top coating above the nickel sub-coating;
c) chromium is one of present in and in contact with the nickel sub-coating;
d) the chromium is one of in the form of metallic Cr and in the form of the ion $Cr^{3+}$;
e) said steel core having a carbon content above 0.20 weight percent; and
f) said wire is in one of a drawn and a rolled work-hardened state.

2. A wire according to claim 1, wherein:
a) said nickel sub-coating has a thickness being one of greater than and equal to 1 micrometer (μm).

3. A wire according to claim 2, wherein:
a) said wire further includes a Fe—Ni alloy interlayer between the nickel sub-coating and the steel core.

4. A wire according to claim 3, wherein:
a) said wire further comprises a Ni—Zn alloy interlayer between the nickel sub-coating and the one of the zinc and zinc alloy top coating.

5. A wire according to claim 4, wherein:
a) no Fe—Zn alloy interlayer is present.

6. A wire according to claim 5, wherein:
a) the one of the zinc and the zinc alloy top coating comprises between 0.5 and 10 weight percent aluminum.

7. An off-shore non-bonded flexible pipe including the wire of claim 1.

8. An off-shore tow leader cable including the wire of claim 1.

9. A wire according to claim 1, wherein:

a) said wire further includes a Fe—Ni alloy interlayer between the nickel sub-coating and the steel core.

10. A wire according to claim 1, wherein:

a) said wire further comprises a Ni—Zn alloy interlayer between the nickel sub-coating and the zinc or zinc alloy top coating.

11. A wire according to claim 1, wherein:

a) no Fe—Zn alloy interlayer is present.

12. A wire according to claim 1, wherein:

a) said zinc alloy in the top coating comprises between 0.5 and 10 weight percent aluminum.

13. A method of manufacturing a wire, said method comprising the steps of:

a) providing a steel core with a carbon content above 0.20 weight percent;

b) coating said steel core with a nickel sub-coating;

c) coating one of a zinc and a zinc alloy top coating on top of said nickel sub-coating;

d) one of drawing and rolling said wire with said nickel sub-coating and with said one of the zinc and zinc alloy top coating to a final cross-section; and e) guiding said wire in a bath of $Cr^{3+}$-salts.

14. A wire for external exposure, said wire comprising:

a) a steel core;

b) a nickel sub-coating;

c) one of a zinc and a zinc alloy top coating above the nickel sub-coating;

d) chromium being in contact with the nickel sub-coating;

e) the chromium being one of in the form of metallic Cr and in the form of the ion $Cr^{3+}$;

f) the steel core having a carbon content above 0.20 weight percent; and g) the wire being in one of a drawn and a rolled work-hardened state.

15. A wire according to claim 14, wherein:

a) the nickel sub-coating has a thickness of at least 1 micrometer (μm).

16. A wire according to claim 14, wherein:

a) the wire includes a Fe—Ni alloy interlayer between the nickel sub-coating and the steel core.

17. A wire according to claim 14, wherein:

a) the wire includes a Ni—Zn alloy interlayer between the nickel sub-coating and the one of the zinc and zinc alloy top coating.

18. A wire according to claim 14, wherein:

a) no Fe—Zn alloy interlayer is present.

19. A wire according to claim 14, wherein:

a) the one of the zinc and the zinc alloy top coating comprises between 0.5 and 10 weight percent aluminum.

* * * * *